United States Patent [19]

Forster

[11] 4,252,508

[45] Feb. 24, 1981

[54] PUMP UNIT

[75] Inventor: Franz Forster, Muhlbach, Fed. Rep. of Germany

[73] Assignee: Linde Aktiengesselschaft, Muhlbach, Fed. Rep. of Germany

[21] Appl. No.: 16,527

[22] Filed: Mar. 1, 1979

Related U.S. Application Data

[63] Continuation-in-part of Ser. No. 845,908, Oct. 27, 1977, abandoned.

[30] Foreign Application Priority Data

Mar. 1, 1978 [DE] Fed. Rep. of Germany ..... 2808786

[51] Int. Cl.[3] ..... F04B 23/06; F01B 13/04

[52] U.S. Cl. ..... 417/429; 91/504; 91/499

[58] Field of Search ..... 91/499 G, 507; 92/12.2; 417/426 G, 429; 74/417, 421 A, 665 F, 665 GB, 665 S

[56] References Cited

U.S. PATENT DOCUMENTS

| | | | |
|---|---|---|---|
| 2,192,146 | 2/1940 | Nightenhelser et al. | 74/665 GB |
| 2,914,219 | 11/1959 | Chiantelassa | 91/50 P |
| 2,956,407 | 10/1960 | Grabow | 92/12.2 |
| 3,442,181 | 5/1969 | Olderaan | 92/12.2 |
| 3,943,789 | 3/1976 | Mann | 74/417 |
| 4,126,096 | 11/1978 | Malavard | 74/417 |

FOREIGN PATENT DOCUMENTS

| | | | |
|---|---|---|---|
| 2316675 | 10/1974 | Fed. Rep. of Germany | 417/426 |
| 2649127 | 3/1978 | Fed. Rep. of Germany | 91/505 |
| 909041 | 4/1946 | France | 74/665 S |

*Primary Examiner*—William L. Freeh

[57] ABSTRACT

A pump unit includes two main variable displacement axial piston pumps with coaxial input drive members. A power input shaft to the pump unit is mounted for rotation in the housing along an axis perpendicular to the common axis of the main pump drive members. A first bevel gear mounted within the housing on the power input shaft meshes with a second bevel gear which is rotatable about the common axis of the main pump drive members and drivingly connected with at least one of the pump drive members. The housing has at least one flange defining a surface on which an auxiliary pump may be mounted. The auxiliary pump has an input shaft which extends through an opening in the housing defined by the flange. A third bevel gear is mounted on the auxiliary pump input shaft from inside the housing and meshes with the second bevel gear. The pitch diameter of the second bevel gear is greater than the pitch diameters of the first and third bevel gears so that the tips of the teeth of the third bevel gear clear the tips of the teeth of the first bevel gear. It is contemplated that the housing could be provided with three flanges each lieing in a plane parallel to the common axis of the main pump drive members. Two of the flanges are also parallel to the axis of the input drive member and the third is perpendicular to the axis of the input drive member.

5 Claims, 3 Drawing Figures

PUMP UNIT

CROSS REFERENCE TO RELATED APPLICATION

This application is a continuation-in-part of U.S. Patent Application Ser. No. 845,908, filed Oct. 27, 1977, now abandoned, corresponding to German Application P26 49 127.0.

BACKGROUND OF THE INVENTION

The present invention relates to a pump unit having two main axial displacement piston pumps and one or more auxiliary pumps connected with the pump unit. In particular, the present invention relates to a unique drive arrangement which simplifies the mounting of auxiliary pumps in such a pump unit.

It is a known practice to construct a pump unit in which two axial displacement piston pumps are mounted coaxially on a common drive shaft with a power input shaft perpendicular to the common drive shaft. The power input shaft and the common drive shaft are provided with bevel gears in meshing engagement to transmit power from the input shaft to the common drive shaft. This is illustrated the above-mentioned U.S. Patent Application, Ser. No. 845,908.

It is also known to modify such a pump unit to permit an auxiliary pump to be mounted as part of the same unit. This has required that the power input shaft be offset from the common drive shaft of the main pumps and that complicated gearing be used to connect the power input shaft with the common drive shaft. These gears are more difficult and expensive to manufacture than bevel gears.

SUMMARY OF THE INVENTION

The present invention provides a new and improved pump unit having one or more auxiliary pumps and two main axial displacement piston pumps connected by a common drive shaft and driven by a power input shaft which is perpendicular to the common drive shaft. According to the present invention, such a pump unit may be constructed using ordinary bevel gears.

A power input shaft from a power source extends into a housing for the pump unit and is provided with a bevel gear which engages a bevel gear on a common drive shaft which drives the two main pumps. As many as three auxiliary pumps may be mounted on flanges on the housing, and the input shaft of each auxiliary pump includes a bevel gear meshing with a bevel gear fixed to the common drive shaft.

To avoid interference between gear teeth, the bevel gear connected with the common drive shaft has a pitch diameter which is larger than the pitch diameter of any of the other bevel gears which mesh with it. In this way, the tips of the teeth on the gear on the power input shaft and the tips of the teeth on the gears on the input shafts of the auxiliary pumps do not interfere with each other, and at the same time, the teeth of each of these gears can meshingly engage the teeth on the bevel gear connected with the common drive shaft of the main pumps.

BRIEF DESCRIPTION OF THE DRAWINGS

The above and other features of the present invention will become more clear to those skilled in the art to which it relates upon reading the following description of preferred embodiments together with the accompanying drawings in which.

DESCRIPTION OF PREFERRED EMBODIMENT

Figure 1:
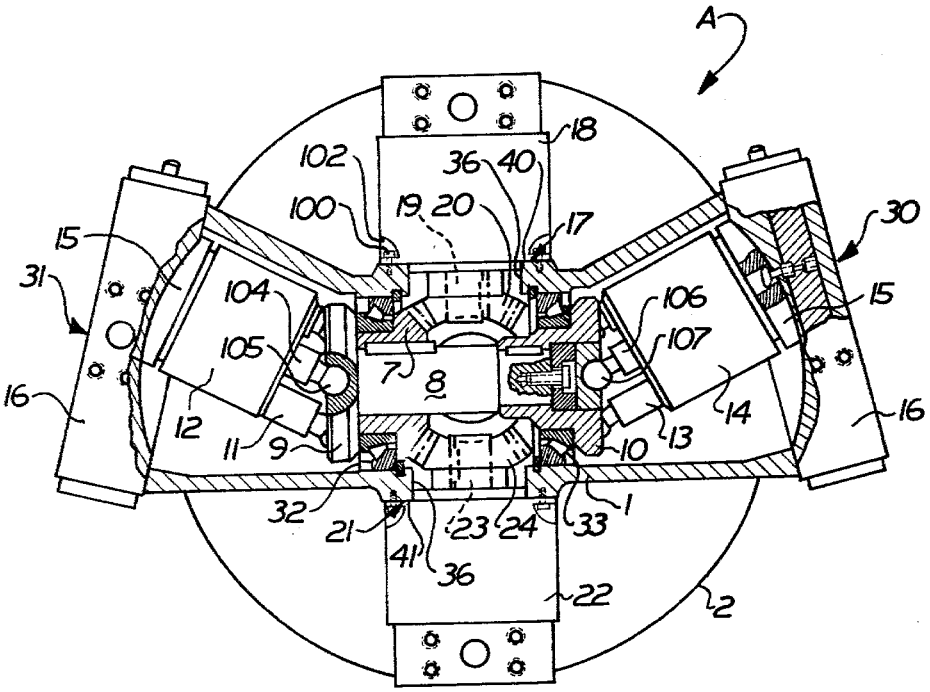
FIG. 1 shows a view of a pump unit constructed in accordance with the present invention, looking from the direction of the input drive shaft.
Figure 2:
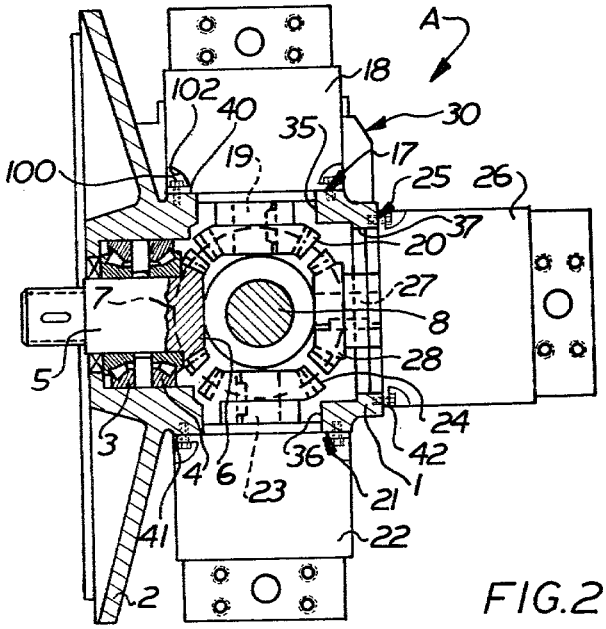
FIG. 2 is a vertical section view of the pump unit of FIG. 1, taken along the plane of the axis of the input shaft.
Figure 3:
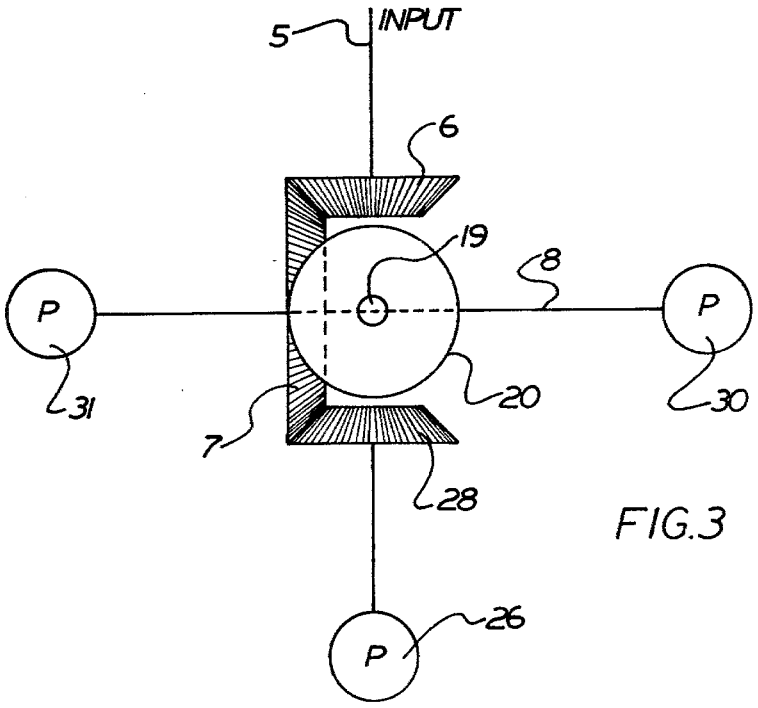
FIG. 3 is a schematic illustration of the present invention viewed from the top in the direction of the axis of rotation of the pump 18 shown in FIG. 1.

A pump unit A constructed in accordance with the present invention is illustrated in FIGS. 1 and 2 and FIG. 3 shows schematically the same pump unit. The housing 1 of the pump unit has a flange 2 which is adapted to be connected with a power source, such as an internal combustion engine (not shown). The power input shaft 5 is driven by the power source, and the power input shaft 5 drives two main pumps 30 and 31 and also three auxiliary pumps 18, 22 and 26 through an arrangement of bevel gears (to be discussed below).

The main pumps 30 and 31 are conventional, variable displacement axial piston pumps of the slide block type. The input drive members 9 and 10 of the main pumps 30 and 31 are connected at opposite ends of a common drive shaft 8. As the drive shaft 8 and the input drive members or plates 9 and 10 are rotated, the pistons 11 and 13 are rotated about the axis of middle pivots 104 and 106 respectively. The rotation of the pistons 11 and 13 about the middle pivots 104 and 106 causes the cylinder blocks 12 and 14 to rotate about the same axis, and the pistons 11 and 13 reciprocate in the cylinder blocks 12 and 14 in a well-known manner.

Also, as is conventional, the displacement of the main pumps 30 and 31 may be varied by adjusting an adjusting device 16 which engages a swivel support or slide block 15 to vary the angle between the axis of rotation of the plates 9 and 10 and the axis of the middle pivots 104 and 106 about which the cylinders 12 and 14 rotate. The middle pivots 104 and 106 have ball ends 105 and 107 which are received in corresponding sockets in the centers of the drive flanges 9 and 10, respectively. If it is desired, the displacement of the pumps 30 and 31 may be varied independently of each other so that one pump may have a larger displacement than the other.

Power is transmitted from the power input shaft 5 to the common drive shaft 8 through bevel gears 6 and 7. The power input shaft 5 is mounted in the housing 1 by an opposed pair of tapered roller bearings 3 and 4, and the common drive shaft 8 is mounted in the housing for rotation about an axis perpendicular to the axis of the power input shaft by similar tapered roller bearings 32 and 33. Bevel gear 6 is connected with one end of the power input shaft 5 and meshes with bevel gear 7 which is connected with the common drive shaft 8 of the main pumps 30 and 31. Thus mechanical power is transmitted from the power input shaft 5 through bevel gears 6 and 7 to the common drive shaft 8 which is perpendicular to the power input shaft 5. Specifically, the axes of the drive shaft 8 and the power input shaft 5 lie in a common plane.

Auxiliary pumps 18, 22 and 26 are connected with the housing 1 and form a part of the pump unit A. The input shafts 19, 23 and 27 of the auxiliary pumps 18, 22 and 26, respectively, are provided with bevel gears 20, 24 and 28, respectively, which engage the bevel gear 7 connected with the common drive shaft 8. Thus, when the power input shaft 5 rotates, it drives the bevel gear 7 on the common drive shaft 8, and the auxiliary pumps 18, 22 and 26 are driven by the bevel gear 7.

To mount the auxiliary pumps 18, 22 and 26, the housing 1 is provided with flanges 17, 21 and 25 against which an end face of each of the auxiliary pumps abuts. The flanges 17 and 21 include annular surfaces 40 and 41 which are parallel to each other and to the axes of rotation of the common drive shaft 8 and the power input shaft 5. The flange 25 includes an annular surface 42 which is parallel to the common drive shaft 8 and perpendicular to the power input shaft 5.

The flanges 17, 21 and 25 also include cylindrical surfaces 35, 36 and 37, respectively, which receive corresponding cylindrical pilot surfaces on the auxiliary pumps 18, 22 and 26, respectively. The flanges 17, 21 and 25, and the cylindrical surfaces 35, 36 and 37 serve to mount the auxiliary pumps 18, 22 and 26, with the input shafts 19, 23 and 27 of each perpendicular to the axis of the common drive shaft 8 of the main pumps.

Each of the auxiliary pumps 18, 22, and 26 is fastened to the respective flange 17, 21, and 25, by means of four bolts or other suitable fasteners 100. The housing of each pump has four curved recesses 102 which permit the bolts 100 to be inserted. The bolts 100 are received in threaded passages in the housing 1 to draw the pumps 18, 22, and 26 into tight engagement with the annular surfaces 40, 41 and 42.

In accordance with a feature of the present invention, the sizes of the bevel gears 6, 7, 20, 24 and 28 are selected to avoid interference between them as they rotate. This is accomplished by selecting the pitch diameter of bevel gear 7 connected with the common drive shaft 8 larger than the pitch diameter of the remaining bevel gears 6, 20, 24 and 28. Each of the remaining bevel gears 6, 20, 24 and 28 has the same pitch diameter and each meshes with the bevel gear 7. The pitch diameter of the bevel gear 7 is selected so that the tips of the teeth of the remaining bevel gears 6, 20, 24 and 28 clear each other.

It is contemplated that the flange 10 of the main pump 30 could be driven by a bevel gear which is identical to the bevel gear 7. In this case, the common drive shaft would be split and have a thrust bearing to support the two plates 9 and 10 against each other and to permit relative rotation between them. In this arrangement bevel gears 6, 20, 24 and 28 would then mesh both with bevel gear 7 and with the bevel gear which is analogous to it and connected with the plate 10. This forms a mechanical lock between the bevel gear 7 to the analogous gear connected with the drive plate 10.

It is further contemplated by the present invention that fewer than three auxiliary pumps be connected with the housng 1. In this case, the one or two of the flanges 17, 21 and 25 to which a pump is not connected is covered with a cover plate to prevent the escape of lubricant.

What is claimed is:

1. A pump unit comprising a housing, an input shaft rotatably mounted in said housing, a first bevel gear fixedly connected with said input shaft, five rotary axial piston pumps connected with said housing, one of said pumps having an axis of rotation coaxial with the axis of rotation of said input shaft, a first pair of said pumps having a first common axis of rotation perpendicular to said axis of rotation of said input shaft, a second pair of pumps having a second common axis of rotation perpendicular to said axis of rotation of said input shaft and said first common axis of rotation, said pumps comprising said first pair of pumps lying on opposite sides of a plane defined by said second common axis of rotation and said axis of rotation of said one of said pumps, said pumps comprising said second pair of pumps lying on opposite sides of a plane defined by said first common axis and said axis of rotation of said one of said pumps, a common drive shaft coaxial with said first common axis and connected with said first pair of rotary pumps for transmitting power thereto, a second bevel gear fixedly connected with said common drive shaft and disposed in meshing engagement with said first bevel gear, a third bevel gear connected with one of said second pair of pumps, a fourth bevel gear connected with the other one of said second pair of pumps, said third and said fourth bevel gears being rotatable about and coaxial with said second common axis and disposed in meshing engagement with said second bevel gear, a fifth bevel gear connected with said one of said pumps, said fifth bevel gear being rotatable about and coaxial with said input shaft and disposed in meshing engagement with said second bevel gear, said second bevel gear having a larger pitch diameter than any of said first, third, fourth and fifth bevel gears, whereby said first, third, fourth and fifth bevel gears are free of contact with each other.

2. A pump unit as set forth in claim 1 wherein said first, third, fourth and fifth bevel gears have the same pitch diameter.

3. A pump unit as set forth in claim 1 or 2 wherein said housing includes a first pump mounting flange having surfaces defining a plane perpendicular to the axis of rotation of said input shaft, said one of said pumps having a mounting surface disposed in abutting engagement with said first flange, a second pump mounting flange having surfaces defining a plane perpendicular to said first common axis, one of said first pair of said pumps having a mounting surface disposed in abutting engagement with said second flange, a third pump mounting flange having surfaces defining a plane perpendicular to said first common axis, the other one of said first pair of said pumps having a mounting surface disposed in abutting engagement with said third flange, a fourth flange having surfaces defining a plane perpendicular to said second common axis, one of said second pair of said pumps having a mounting surface disposed in abutting engagement with said fourth surface, and a fifth flange having surfaces defining a plane perpendicular to said second common axis, the other one of said second pair of said pumps having a mounting surface disposed in abutting engagement with said fifth surface.

4. A pump unit as set forth in claim 1 or 2 wherein at least one of said pumps is of the slide block type.

5. A pump unit as set forth in claim 4 wherein said pumps connected with said common drive shaft are of the slide block type.

* * * * *